US005865330A

United States Patent [19]

Buono

[11] Patent Number: 5,865,330

[45] Date of Patent: Feb. 2, 1999

[54] CHILD RESISTANT CAP

[75] Inventor: Caetano Buono, Staten Island, N.Y.

[73] Assignee: Van Blarcom Closures, Inc., Brooklyn, N.Y.

[21] Appl. No.: 735,793

[22] Filed: Oct. 21, 1996

[51] Int. Cl.[6] ..... B65D 50/08

[52] U.S. Cl. ..... 215/216; 215/219; 215/221

[58] Field of Search ..... 215/216, 221, 215/330, 217, 218, 219

[56] References Cited

U.S. PATENT DOCUMENTS

| | | | |
|---|---|---|---|
| 3,989,152 | 11/1976 | Julian . | |
| 4,149,646 | 4/1979 | Julian . | |
| 4,413,742 | 11/1983 | Sandhaus . | |
| 4,464,316 | 8/1984 | Michaels | 215/221 X |
| 4,630,743 | 12/1986 | Wright | 215/216 |
| 4,752,013 | 6/1988 | Miller et al. . | |
| 4,752,014 | 6/1988 | House et al. . | |
| 5,383,564 | 1/1995 | Hamilton et al. | 215/221 |
| 5,449,077 | 9/1995 | Seidler . | |
| 5,460,281 | 10/1995 | Rapchak et al. . | |
| 5,462,182 | 10/1995 | Opresco | 215/217 X |
| 5,577,624 | 11/1996 | Berta et al. | 215/221 |
| 5,671,853 | 9/1997 | Herr | 215/216 |
| 5,699,922 | 12/1997 | Harding | 215/330 X |
| 5,706,963 | 1/1998 | Gargione | 215/217 X |

*Primary Examiner*—Stephen K. Cronin
*Assistant Examiner*—Nathan Newhouse
*Attorney, Agent, or Firm*—Cohen, Pontani, Lieberman & Pavane

[57] ABSTRACT

A child-resistant cap and container including an inner and an outer skirt depending downwardly from the top wall of the cap. The inner skirt has an internally threaded surface for engagement with the externally threaded neck of the container. The outer skirt has a pair of longitudinal slots defined in the bottom portion of the outer skirt for forming a flexible tab therebetween. A tooth is radially spaced from the container neck for edgewise engagement with the tab when the cap is in its locked position. The locked cap can be removed from the container only by depressing the tab inwardly to clear the tooth as the cap is rotated in a retrograde or opening direction.

5 Claims, 4 Drawing Sheets

CHILD RESISTANT CAP

BACKGROUND OF THE INVENTION

1. Field of the Invention

The invention is directed to a child-resistant cap and container and, more particularly, to a child-resistant cap and container having a flexible tab formed in a bottom portion of an outer skirt and a tooth affixed at the neck of a bottle for edgewise locking engagement with the tab.

2. Description of the Prior Art

Numerous child-resistant mechanisms for preventing access to containers storing dangerous substances such as medicine, household cleaners, poisons or the like are known. Most, however, are complicated in design which drives up the cost of manufacturing the caps and containers. Also, typical child-resistant containers are often difficult to open as they require a user to exert an appreciable amount of force while simultaneously engaging in a sequence of complex manipulative movements to release the cap closure mechanism. For these reasons, many child-resistant mechanisms are unsuitable for physically feeble persons such as the elderly and the sick.

For example, U.S. Pat. Nos. 3,989,152 and 4,149,646 to Julian disclose a child-resistant cap having a tab provided in the bottom of the skirt of the cap, and a container having an abutment disposed at the neck of the container for locking engagement with the tab. A user is required to squeeze or flex the entire skirt while twisting the cap off so as to deflect the tab radially inwardly and around the abutment at the container neck. Such squeezing action would require an appreciable amount of force which may not be available to a physically feeble user.

Another example, U.S. Pat. No. 4,413,742 to Sandhaus discloses a cap having a tab that is frictionally receivable in a recess defined in the neck of the container. To remove the cap, the user is required to push out the hinged tab by, for example, depressing the top of the cap. To reinstall the cap over the container, the user must thread the cap onto the container neck and realign the tab with the recess in the neck.

In still another example, U.S. Pat. No. 4,752,014 to House et al. discloses a child-resistant closure having a ratchet type mechanism. The cap includes a flexible tab notched in the depending skirt of the cap. The tab is movable in the radially outward direction and has a pawl extending from a bottom surface of the tab. A plurality of recesses are formed at the neck of the container for receiving the pawl. Thus, as a user threads the cap onto the container neck, the pawl is brought into ratchet engagement with the recesses in the neck. To open the container, a user is required to pivot the tab and the pawl radially outwardly so as to remove the pawl from the recess received therein. This ratchet type mechanism is complex in design and expensive to manufacture. Furthermore, this design does not provide the requisite positive locking unless the user screws the cap on with adequate force so that the pawl is sufficiently received in one of recesses.

Other child-resistant closures with tab-actuated mechanisms are disclosed in U.S. Pat. No. 5,449,077 to Seidler, U.S. Pat. No. 5,460,281 to Rapchak et al., and U.S. Pat. No. 4,752,013 to Miller et al.

OBJECTS AND SUMMARY OF THE INVENTION

An object of the invention is to provide a low-cost child-resistant cap and container that is easily operated by a physically feeble person.

Another object of the invention is to provide a cap having concentric inner and outer skirts, the outer skirt having a radially deflectable tab formed by and between a pair of longitudinal slots in the bottom portion of the outer skirt for edgewise locking engagement with a tooth affixed proximate the neck of a container.

Still another object of the invention is to provide a child resistant cap with a locking mechanism which gives off an audible sound when the cap is rotated into a proper locking position.

In accordance with a preferred embodiment of the present invention, these and other objects are attained by providing a combined child-resistant cap and container. The container has an externally threaded neck portion defining an opening. The container includes a tooth affixed at a radial distance from the neck portion and projecting axially toward the opening. The cap has a top wall and an inner and outer skirt depending from the top wall of the cap. The inner skirt is concentric with and spaced inward of the outer skirt and has a threaded surface complementary to and engageable with the threaded neck portion of the container to permit rotation of the cap into a locked position. The outer skirt includes a flexible tab formed by and between a first and a second longitudinal slot provided in a bottom portion of the outer skirt. The flexible tab is movable radially between a normal position and a radially inwardly deflected position. The tab is spaced from said neck portion at substantially that radial distance so that when the cap is rotated into the locked position. The tab and the tooth are edgewise engageable for preventing removal of the cap from the container by rotating the cap in a retrograde or opening direction. The cap is removable from the container only when the flexible tab is moved to the radially inwardly deflected position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not drawn to scale and, as such, are merely conceptual in disclosing the preferred embodiments of the invention.

DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
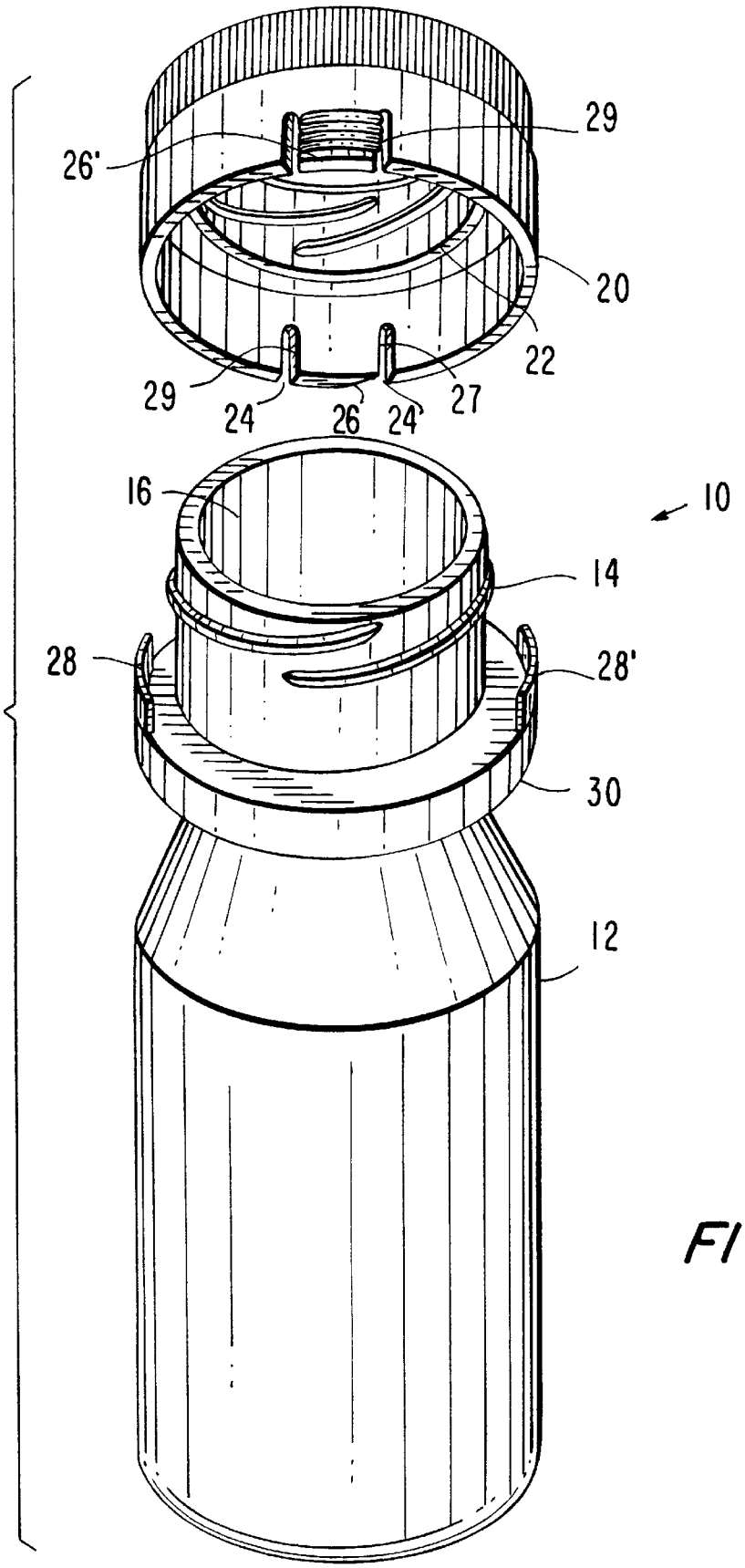
FIG. 1 is a perspective view of an embodiment of the child resistant cap and container constructed in accordance with the present invention.

Referring now to FIG. 1 in detail, a combined child-resistant cap and container 10 is constructed in accordance with the present invention. As seen, the container 12 has a threaded neck portion 14 defining an opening 16 into the container 12 and the cap 18 is threadedly engageable with the container neck 14 to close the container.

Figure 2:
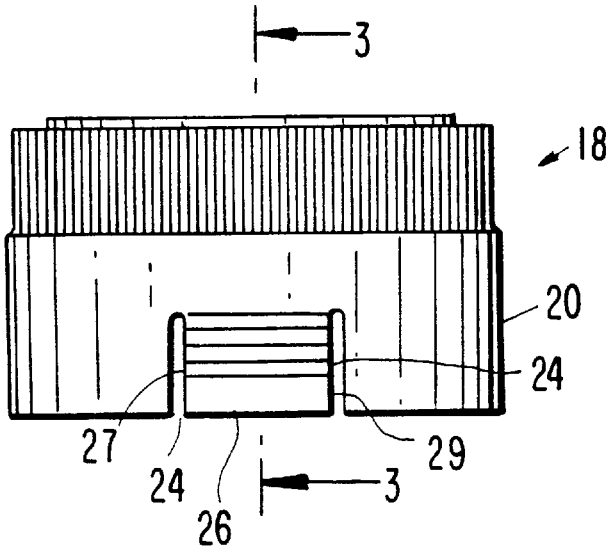
FIG. 2 is a side view of the cap of the embodiment of FIG. 1.
Figure 3:
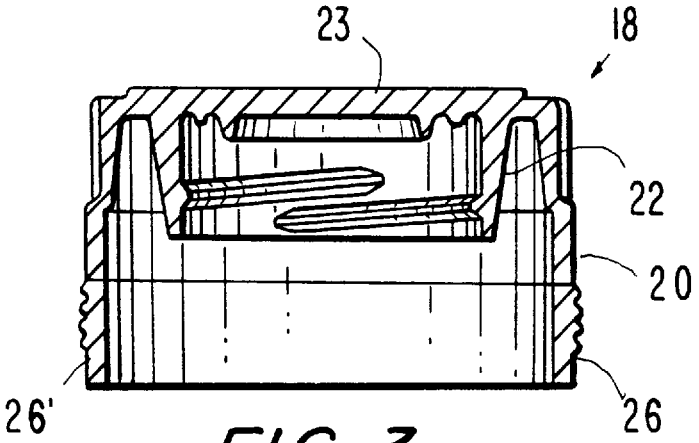
FIG. 3 is a sectional view of the cap along lines 3—3 of FIG. 2
Figure 6:
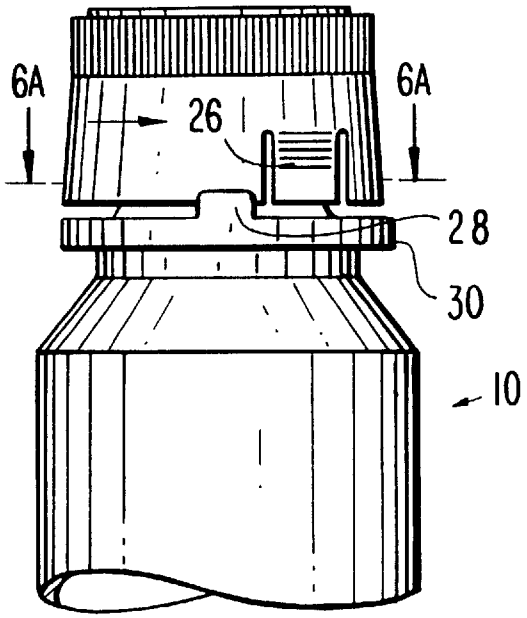
FIG. 6 is a side view of the child-resistant cap and container of FIG. 1 with the cap in the unlocked position.

In the embodiment shown in FIGS. 1–3, the cap 18 includes an outer skirt 20 and an inner skirt 22 concentric and radially inward of the outer skirt 20, with each skirt depending downwardly or axially from a top wall 23 of the cap. The outer skirt 20 is preferably made of a flexible material and dimensioned to have a length different from that of the inner skirt 22 (see FIG. 3). The outer skirt 20 includes at least a pair of longitudinal slots 24 in the bottom portion of the outer skirt 20 for forming a flexible tab 26 therebetween. Thus formed, the flexible tab 26 has a first lateral edge 27 and a second lateral edge 29, and a free end. The tab 26 is radially movable as by flexing between at least two positions: a normal or undeflected position and a radially inwardly deflected position. The tab 26 includes an outside surface that is preferably tapered such that the first lateral edge 27, the "leading" edge during cap rotation for locking, is substantially flush with the outside circumferential surface of the outer skirt 20 while the second lateral edge 29, the "trailing" edge during cap rotation for closure, projects radially beyond the outside surface of the outer skirt (thus forming a raised edge relative to the outer skirt). It is contemplated that the outside surface of the tab 26 between the first and second lateral edges 27, 29 need not be tapered but may, for example, be configured as a "ramp" having a "plateau" portion. Although presently deemed as less desirable, the tab may be shaped so that both the "leading" edge 27 and "trailing" edge 29 project radially beyond the outer skirt 20, so that there is no surface ramp between the two lateral edges 27, 29. Other workable shapes for tab 26 will suggest themselves to others skilled in the art.

In view of the disclosure provided herewith, it will be readily appreciated that the flexibility or resiliency of the tab 26 may be adjusted by, for example, varying certain dimensions of the tab 26 such as, for example, the length, width, thickness and shape of the tab 26 as well as the material from which the cap is made. The length of the tab 26 may be varied by, for example, changing the length of slots 24. The width of the tab 26 can be varied by changing the spacing between the two tab-defining slots 24 and/or the width of each slot 24. The flexibility of the tab 26 may also be affected by the inherent stiffness (e.g. Young's Modulus) of the skirt material. Thus, an appropriate selection of skirt material could also provide the tab 26 with the desired flexibility. Furthermore, not only does the flexible tab 26 provide the user with the desired force-deflection characteristic, it could also give off an audible sound when freed from a deflected position. The pitch and loudness of the audible sound are dictated by the flexibility of the tab.

The inner skirt 22 of the cap 20 has an internally threaded surface and is preferably made of a resilient material suitable for forming a liquid seal with the complementarily threaded neck 14 of the container 12 so that liquid may be maintained therein.

As shown in FIG. 1, the container 12 includes at least one tooth 28 projecting axially upwardly toward the opening 16 as, for example, from a radial flange 30 affixed proximate the bottom of the threaded neck portion 14 of the container 24. Preferably, the tooth 28 is radially spaced from the neck 14 of the container 12 at a greater radial distance from the axis of the combined cap and container than that of the outer surface of the outer skirt 20 such that the outer skirt 20 can be rotated relative to the tooth 28. The tooth 28 has an edge configured for contact engagement with the raised lateral edge 29 of tab 26. The tooth 28 may be arcuately shaped.

Figure 4:
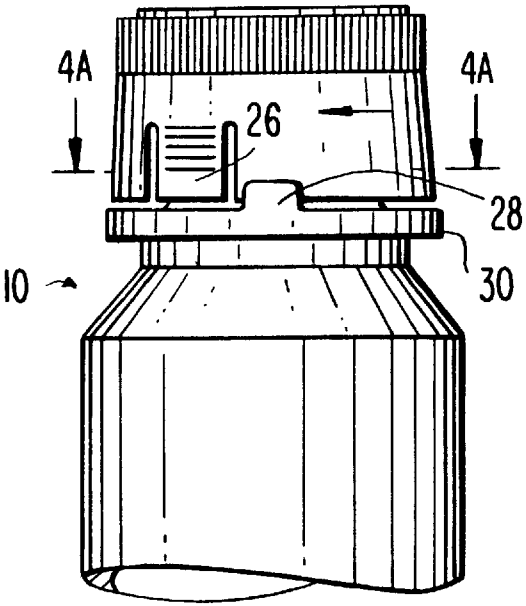
FIG. 4 is a side view of the child-resistant cap and container of FIG. 1 with the cap in the locked position.
Figure 6A:
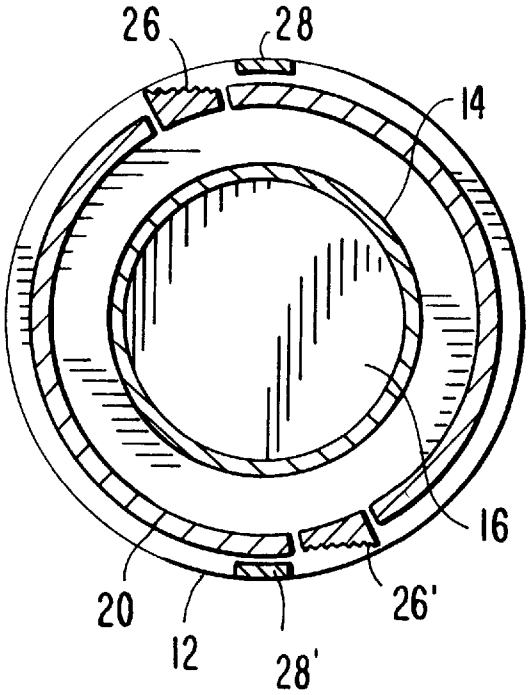
FIG. 6A is a sectional view of the child-resistant cap and container along lines 6A—6A of FIG. 6.
Figure 4A:
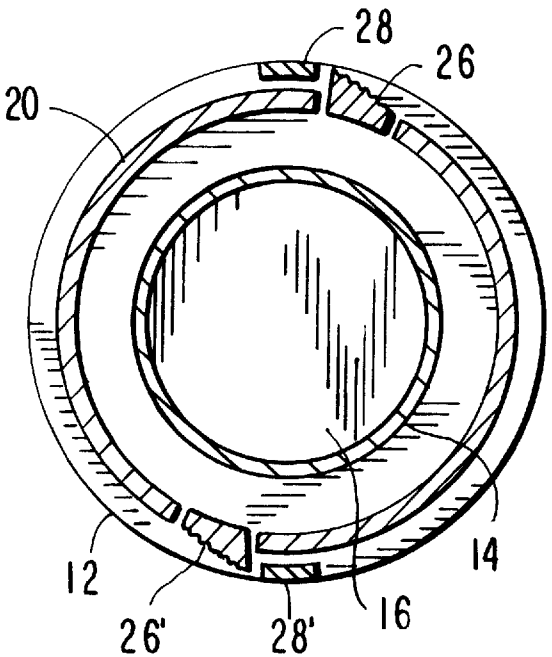
FIG. 4A is a sectional view of the child-resistant cap and container along lines 4A—4A of FIG. 4.

When the cap 18 is in a locked position, the raised edge 29 of tab 26 and the confronting edge of tooth 28 are aligned for edgewise contact engagement so that the cap 18 is prevented from twisting in the retrograde or opening direction for removal (see FIGS. 4 and 4A). In this locked position, the cap 18 can only be released from the container 12 by deflecting the tab 26 from its normal position to its radially inward position to clear the path of the tooth 28 as the cap 26 is rotated in the retrograde direction.

In a presently preferred embodiment, as depicted in FIG. 1, there further comprises a second set of cooperating tapered tab 26' and arcuate tooth 28'. For ease of actuation, the tab 26' and tooth 28' may be disposed diametrically opposite the corresponding first set of tab 26 and tooth 28, respectively. It will be appreciated that the second set of tab 26' and tooth 28' increases the ability of the cap 18 to resist tampering by a child. Such increased child-resistance is due in part to the increase in "complexity" of the manipulative motions required for releasing the cap 18 and to the greater retaining forces afforded by the increased force-bearing areas provided by tab 26' and tooth 28'.

It is apparent that tabs 26, 26', due to their tapered geometry, may be rotated into their locked positions automatically without requiring depression of tabs 26, 26'. That is, if they have a ramp-like or tapered shape, the tabs will be carried inwardly by teeth 2 as the cap is turned without any need for manually flexing them. Moreover, after the tapered tabs 26, 26' slide past the inside surfaces of their respective teeth 28, 28' during cap rotation for locking, the tabs will snap into their normal positions while giving off an audible sound such as, for example, a "POP", thereby alerting the user that the cap is in its properly locked position. Of course, the loudness and pitch of the audible sound would depend on the selected flexibility of the tabs 26, 26'.

Figure 5:
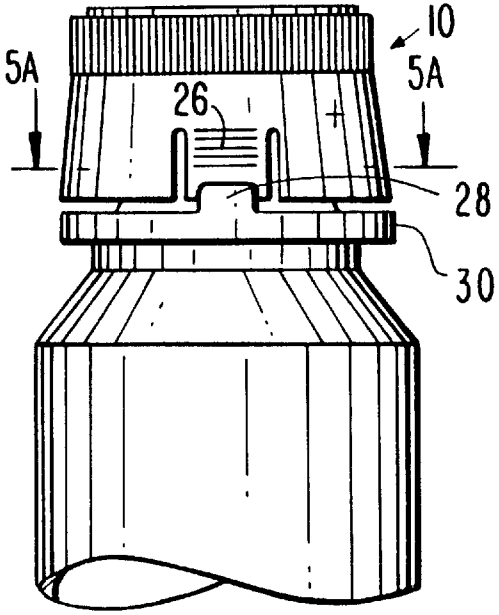
FIG. 5 is a side view of the child-resistant cap and container of FIG. 1 with the cap in an intermediate position.
Figure 5A:
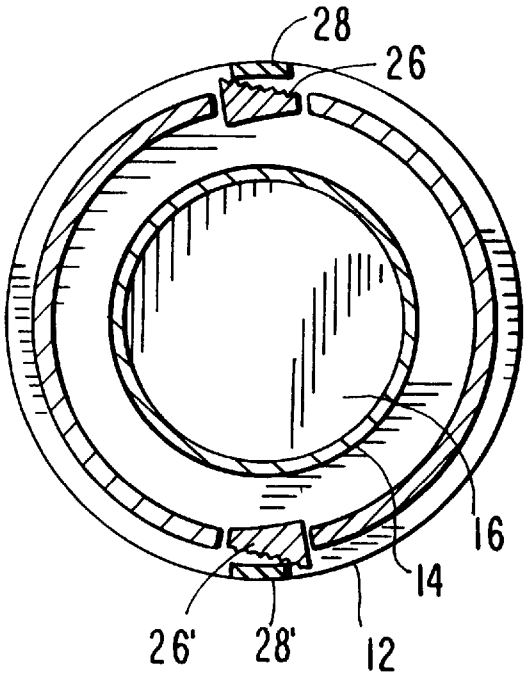
FIG. 5A is a sectional view of the child-resistant cap and container along lines 5A—5A of FIG. 5.

Thus, in accordance with the presently preferred embodiment, a user may lock the child-resistant cap by simply twisting the cap 18 onto the threaded container neck 14 without depressing tabs 26, 26'. During cap rotation, each tapered tab slides along the inside surface of the corresponding tooth which causes the tab to deflect radially inwardly (see FIGS. 5 and 5A). After clearing the corresponding teeth, each of the tabs 26, 26' snaps back to its undeflected position while giving off a popping sound so as to indicate audibly to the user that the cap is in its properly locked position. Once locked, a child is prevented from rotating the cap 18 in the retrograde or opening direction. This results from the raised lateral edges 29, 29' of tabs 26, 26' and the confronting edges of the corresponding teeth 28, 28' are rotatively aligned and contactingly engageable with each other in the retrograde direction by virtue of their substantially identical radial spacing from the container neck 14 (see FIGS. 4 and 4A). To release the cap 18 from the container 12 the adult user simply squeezes the flexible tabs 26, 26' radially inwardly so as to clear the path of corresponding teeth 28, 28' while twisting the cap in the retrograde direction (see FIGS. 5, 5A, 6 and 6A).

From the aforementioned description, it will be recognized that the child resistant cap and container 10 herein disclosed provides a closure mechanism that is easily releasable by a physically feeble adult user since only a minimal amount of force is required for actuation of the flexible tabs 26, 26'. Moreover, the cap provides to the user audible sounds and/or simple visual verification that the cap is properly locked. Yet, the cap 18 cannot be readily removed by, for example, a 2-year old child who has not yet developed the necessary mental skills and/or physical dexterity to manipulate the tabs 26, 26' for cap removal.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A combined child-resistant cap and container, comprising:

a container having an externally threaded neck portion defining an opening, said container including a tooth affixed at a radial distance from said neck portion and projecting axially toward the opening, said tooth having an inside surface facing said neck portion; and a cap comprising a top wall and an inner and outer skirt depending from said top wall of said cap, said inner skirt being concentric with and spaced inward of said outer skirt and having a threaded surface complementary to and engageable with said threaded neck portion of said container to permit rotation of said cap into a locked position, said outer skirt including a flexible downwardly extending tab formed by and between a first and a second longitudinal slot provided in a bottom portion of said outer skirt, said flexible tab having a free end movable radially between an undeflected position and a radially inwardly deflected position, said tab being spaced from said neck portion at substantially said radial distance so that when said cap is rotated into said locked position, said tab and said tooth are edgewise engageable for preventing removal of said cap from said container by rotating said cap in a retrograde direction, said cap being removable from said container only when said free end of said flexible tab is moved to said radially inwardly deflected position so that said free end of said flexible tab slides along the inside surface of said tooth as said cap is rotated in the retrograde direction.

2. The child-resistant cap and container of claim 1, wherein an outside surface of said outer skirt is disposed at a distance less than said radial distance of said tooth, said flexible tab being defined by a first or leading lateral edge and a second or trailing lateral edge, and a tapered outer surface extending from said first lateral edge to said second lateral edge such that said first lateral edge is substantially flush with the outside surface of said outer skirt and said second lateral edge protrudes radially beyond said outside surface of said outer skirt, so that said tooth may slide from said first lateral edge to said second lateral edge thereby causing said flexible tab to move to said radially inwardly deflected position as said cap is rotated into said locked position.

3. The child-resistant cap and container of claim 2, wherein said tab is dimensioned to give off an audible sound upon return from its deflected position to its normal position for alerting a user that said cap is in the locked position.

4. The child-resistant cap and container of claim 1, further including another flexible tab formed by and between a third and a fourth longitudinal slot notched in the bottom portion of said outer skirt, and another tooth affixed at said radial distance from said container neck and projecting radially toward said opening of said container for edgewise engagement with said another tab for preventing removal of said cap from said container.

5. The child resistant cap and container of claim 4, wherein said tabs and teeth are disposed diametrically opposite one another.

* * * * *